US011453935B2

(12) United States Patent
Toda et al.

(10) Patent No.: US 11,453,935 B2
(45) **Date of Patent: *Sep. 27, 2022**

(54) STEEL SHEET FOR HOT STAMPING USE

(71) Applicant: NIPPON STEEL CORPORATION, Tokyo (JP)

(72) Inventors: Yuri Toda, Tokyo (JP); Kazuo Hikida, Tokyo (JP); Shingo Fujinaka, Tokyo (JP); Tomohito Tanaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 79 days.

This patent is subject to a terminal disclaimer.

(21) Appl. No.: 17/042,319

(22) PCT Filed: Mar. 29, 2018

(86) PCT No.: PCT/JP2018/013360

§ 371 (c)(1),
(2) Date: Sep. 28, 2020

(87) PCT Pub. No.: WO2019/186927

PCT Pub. Date: Oct. 3, 2019

(65) Prior Publication Data

US 2021/0115544 A1 Apr. 22, 2021

(51) Int. Cl.
*C22C 38/58* (2006.01)
*C21D 9/46* (2006.01)
(Continued)

(52) U.S. Cl.
CPC ..... *C22C 38/58* (2013.01); *C21D 9/46* (2013.01); *C22C 38/02* (2013.01); *C22C 38/06* (2013.01);
(Continued)

(58) Field of Classification Search
CPC ..... C21D 1/18; C21D 2211/002; C21D 2211/003; C21D 2211/008; C21D 9/00;
(Continued)

(56) References Cited

U.S. PATENT DOCUMENTS 8,962,149 B2 * 2/2015 Oikawa ..... B23K 11/16 428/683
11,180,824 B2 * 11/2021 Toda ..... C22C 38/38
(Continued)

FOREIGN PATENT DOCUMENTS

CN 102906291 A 1/2013
JP 2002-309345 A 10/2002
(Continued)

*Primary Examiner* — Jie Yang
(74) *Attorney, Agent, or Firm* — Birch, Stewart, Kolasch & Birch, LLP

(57) ABSTRACT

A steel sheet for hot stamping use used as a material for a hot stamped article excellent in strength or bending deformability, having a predetermined chemical composition, having a microstructure containing at least one of lower bainite, martensite, and tempered martensite in an area ratio of 90% or more, having an X-ray random intensity ratio of {112}<111> of the crystal grains forming the above lower bainite, martensite, or tempered martensite of 2.8 or more, having a number density of grain size 50 nm or less cementite or epsilon carbides in the microstructure of $1\times10^{16}/cm^3$ or more, and having a grain boundary solid solution ratio Z defined by Z=(mass % of one or both of Nb and Mo at grain boundaries)/(mass % of one or both of Nb and Mo at time of melting) of 0.4 or more.

2 Claims, 1 Drawing Sheet

(51) Int. Cl.

| | |
|---|---|
| ***C22C 38/02*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/44* (2013.01); *C22C 38/48* (2013.01); *C22C 38/50* (2013.01); *C22C 38/54* (2013.01); *C21D 2211/002* (2013.01); *C21D 2211/003* (2013.01); *C21D 2211/008* (2013.01)

(58) Field of Classification Search
CPC ..... C21D 9/46; C22C 38/00; C22C 38/001; C22C 38/02; C22C 38/04; C22C 38/06; C22C 38/12; C22C 38/44; C22C 38/48
USPC ..... 420/106
See application file for complete search history.

(56) References Cited

U.S. PATENT DOCUMENTS

| | | | | |
|---|---|---|---|---|
| 11,180,837 | B2 * | 11/2021 | Toda | C22C 38/44 |
| 2013/0048161 | A1 | 2/2013 | Matsuda et al. | |
| 2013/0095347 | A1 | 4/2013 | Kawasaki et al. | |
| 2016/0145704 | A1 | 5/2016 | Kawasaki et al. | |
| 2017/0096724 | A1 | 4/2017 | Hikida et al. | |
| 2021/0040592 | A1 * | 2/2021 | Toda | C21D 8/0205 |

FOREIGN PATENT DOCUMENTS

| | | | |
|---|---|---|---|
| JP | 5114691 | B2 | 1/2013 |
| JP | 5369714 | B2 | 12/2013 |
| JP | 2014-15638 | A | 1/2014 |
| WO | WO 2015/041159 | A1 | 3/2015 |
| WO | WO 2015/147216 | A1 | 10/2015 |

* cited by examiner

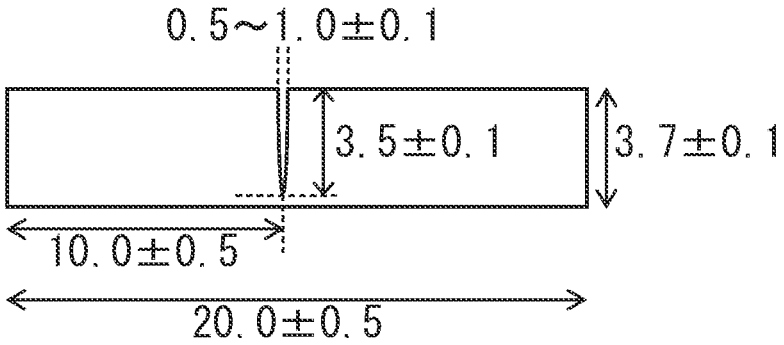
0.5～1.0±0.1
3.5±0.1
3.7±0.1
10.0±0.5
20.0±0.5

STEEL SHEET FOR HOT STAMPING USE

FIELD

The present invention relates to a steel sheet for hot stamping use used for structural members or reinforcing members of automobiles or structures where strength is required, in particular a material of a hot stamped article excellent in strength and bending deformability.

BACKGROUND

In recent years, from the viewpoints of environmental protection and resource saving, lighter weight of automobile bodies is being sought. For this reason, application of high strength steel sheet to automobile members has been accelerating. However, along with the increase in strength of steel sheets, the formability deteriorates, so in high strength steel sheets, formability into members with complicated shapes is a problem.

To solve this problem, hot stamping, where the steel sheet is heated to a high temperature of the austenite region, then press formed, is increasingly being applied. Hot stamping performs press forming and simultaneously quenching in the die, so is being taken note of as a technique achieving both formation of a material into an automobile member and securing strength.

On the other hand, a part obtained by shaping high strength steel sheet by hot stamping is required to exhibit performance absorbing impact at the time of collision.

As art answering this demand, PTL 1 discloses the art of annealing steel sheet for hot stamping use and making Mn or Cr concentrate in the carbides to form difficult to melt carbides and thereby suppress growth of austenite and render it finer by these carbides at the time of heating for hot stamping.

PTL 2 discloses the art of making austenite finer by raising the temperature by a 90° C./s or less heating rate at the time of heating for hot stamping.

PTL 3, PTL 4, and PTL 5 also disclose art for making the austenite finer to improve the toughness.

CITATION LIST

Patent Literature

[PTL 1] WO2015/147216

[PTL 2] Japanese Patent No. 5369714

[PTL 3] Japanese Patent No. 5114691

[PTL 4] Japanese Unexamined Patent Publication No. 2014-15638

[PTL 5] Japanese Unexamined Patent Publication No. 2002-309345

SUMMARY

Technical Problem

However, in the arts disclosed in the above PTLs 1 to 5, it is difficult to obtain further refined austenite. A strength or bending deformability of more than the conventional level cannot be expected to be obtained.

The present invention, in consideration of the technical problem in the prior art, has as its technical problem to secure a better strength or deformability in a hot stamped article of a high strength steel sheet and has as its object the provision of a steel sheet for hot stamping use solving this technical problem.

Solution to Problem

The inventors engaged in intensive studies on a method for solving this technical problem. As a result, they discovered that by making the grain size of the prior austenite of a hot stamped article 3 μm or less, a strength better than in the past was obtained.

Further, they discovered that to make the grain size of the prior austenite of the hot stamped article 3 μm or less, it is sufficient that in the steel sheet before shaping, the number density of the cementite or epsilon carbides be made $1\times10^{16}/m^2$ or more and, furthermore, that one or both of Nb and Mo be made to form solid solutions at the prior austenite grain boundaries to make the brittle strength of the grain boundaries rise.

Furthermore, they discovered that by controlling the X-ray random intensity ratio of {112}<111> of crystal orientation of the crystal grains of lower bainite or martensite or tempered martensite in the steel sheet for hot stamping use, due to the texture memory effect of the austenite and martensite, a crystal orientation with a high effect of suppression of crack progression at the hot stamped article is formed and excellent bending deformability is obtained at the hot stamped article.

The present invention was made after further study based on the above finding and has as its gist the following:

(1) A steel sheet for hot stamping use, a chemical composition of the steel sheet comprising, by mass %, C: 0.35% to 0.75%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0 to 3.00%, P: 0.10% or less, S: 0.10% or less, N: 0.010% or less, and a balance of Fe and unavoidable impurities, a microstructure of the steel sheet comprising at least one of lower bainite, martensite, and tempered martensite in an area ratio of 90% or more, a grain boundary solid solution ratio Z defined by Z=(mass % of one or both of Nb and Mo at grain boundaries)/(mass % of one or both of Nb and Mo at time of melting) being 0.4 or more, an X-ray random intensity ratio of {112}<111> of the crystal grains forming the above lower bainite, martensite, or tempered martensite being 2.8 or more, number densities of total of grain size 50 nm or less cementite and epsilon carbides being $1\times10^{16}/m^2$ or more.

(2) The steel sheet for hot stamping use according to the above (1), wherein the steel sheet comprises a plating layer.

Advantageous Effects of Invention

According to the present invention, it is possible to provide a steel sheet for hot stamping use used as a material of a hot stamped article excellent in strength or bending deformability.

BRIEF DESCRIPTION OF DRAWINGS

FIG. 1 is a view showing the shape of a test piece when measuring a grain boundary solid solution ratio.

DESCRIPTION OF EMBODIMENTS

The present invention is characterized by having number densities of cementite and epsilon carbides of $1\times10^{16}/m^2$ or more and, furthermore, making one or both of Nb and Mo form solid solutions at the prior austenite grain boundaries to make the brittle strength of the grain boundaries rise. Furthermore, it controls an X-ray random intensity ratio of the crystal orientation {112}<111> of the crystal grains of lower bainite, martensite, or tempered martensite of the steel sheet. The inventors engaged in intensive studies and as a result discovered that the above structure is obtained by the following method.

As a first stage, the amount of casting of molten steel per unit time is controlled. Due to this, microsegregation of Mn in the steel slab is suppressed and, further, precipitation of Mo and Nb is suppressed and the amounts of solid solution formed by the Mo and Nb in the steel are made to increase.

If controlling the amount of molten steel cast per unit time to decrease the microsegregation of Mn, the trap sites of P disappear, so P segregates at the prior austenite grain boundaries at the time of finish rolling. This being so, despite the prior austenite grain boundaries having been made finer, a drop in the brittle strength of the grain boundaries is caused and a shock absorption ability cannot sufficiently be obtained. This is because Mn and P are high in affinity, so segregated Mn functions as trap sites for P and elimination of segregation causes P to disperse at the prior austenite grain boundaries. In the present invention, this technical problem is solved by a second stage of control of the rolling conditions.

As the second stage, the rolling reduction and temperature of the hot finish rolling, the cooling temperature after rolling, and the coiling temperature are controlled to thereby keep Mn from concentrating in the carbides and cause formation of easy dissolvable fine carbides and further introduce high density dislocations into the steel. In the present invention, both the finely dispersed carbides and high density dislocations form sites for reverse transformation of austenite whereby the prior austenite grains are refined. To make them effectively function as reverse transformation sites, the carbides are desirably easy to melt. For this reason, it is important not to allow elements inhibiting melting of carbides of Mn, Cr, etc. to concentrate at the carbides.

Further, by suppressing the precipitation of Mo and Nb and causing Nb and Mo to form solid solutions at the grain boundaries of the prior austenite, the precipitation sites of P can be occupied by Nb and Mo and segregation of P at the prior austenite can be eliminated. Due to this, not only is the boundary strength improved by the Mo or Nb, but also reduction of the brittle strength of the grain boundaries can be suppressed.

Furthermore, by controlling the coiling conditions, it is possible to keep Mn from concentrating in the carbides and thereby cause the formation of easy to melt fine carbides. Further, by introducing high density dislocations into the steel, it is possible to make the strength of the austenite rise. When changing the phase from austenite to lower bainite or martensite or tempered martensite, a crystal orientation advantageous for easing the stress occurring due to transformation is preferentially formed. As a result, the X-ray random intensity ratio of {112}<111> of the crystal grains can be controlled.

These steel sheets for hot stamping use exhibit different properties by control of the heating rate in the hot stamping process.

Below, the steel sheet for hot stamping use of the present invention and the method for manufacturing the same will be explained. First, the reasons for limiting the chemical composition of the steel sheet for hot stamping use according to the present invention will be explained. Below, the % according to the chemical composition means mass %.

"C: 0.35% to 0.75%"

C is an important element for the hot stamped article to obtain a 2000 MPa or more tensile strength. With less than 0.35%, the martensite becomes soft and it is difficult to secure 2000 MPa or more tensile strength, so C is made 0.35% or more. Preferably the content is 0.37% or more. Considering the balance of the strength demanded and suppression of early fracture, the upper limit is made 0.75%.

"Si: 0.005% to 0.25%"

Si is an element raising the deformability and contributing to improvement of the shock absorption. If less than 0.005%, the deformability is poor and the shock absorption of the hot stamped article deteriorates, so 0.005% or more is added. Preferably the content is 0.01% or more. On the other hand, if over 0.25%, the amount of solid solution formed in the carbides increases, the carbides become difficult to melt, and the average grain size of the prior austenite of the hot stamped article can no longer be controlled to 3 μm, so the upper limit is made 0.25%. Preferably the content is 0.22% or less.

"Mn: 0.5% to 3.0%"

Mn is an element contributing to improvement of strength by solution strengthening. If less than 0.5%, the solution strengthening ability is poor, the martensite becomes softer, and it is difficult to secure a 2000 MPa or more tensile strength, so 0.5% or more is added. Preferably the content is 0.7% or more. On the other hand, if adding over 3.0%, the amount of solid solution formed in the carbides increases, the carbides become difficult to melt, and the grain size of the prior austenite of the hot stamped article can no longer be controlled to 3 μm or less, so 3.0% is made the upper limit. Preferably, the content is 2.5% or less.

"sol. Al: 0.0002% to 3.0%"

Al is an element acting to deoxidize the molten steel and make the steel sounder. If less than 0.0002%, the deoxidation is insufficient and diameter 5 μm or more coarse oxides are formed causing early fracture, so the sol. Al is made 0.0002% or more. Preferably, the content is 0.0010% or more. On the other hand, if adding over 3.0%, coarse oxides are formed and the toughness is impaired, so the content is made 3.0% or less. Preferably, the content is 2.5% or less, more preferably it is 0.5% or less.

"Cr: 0.05% to 1.00%"

Cr is an element contributing to improvement of strength by solution strengthening. If less than 0.05%, the solution strengthening ability is poor, the martensite becomes softer, and it is difficult to secure a 2000 MPa or more tensile strength, so the content is made 0.05% or more. Preferably the content is 0.1% or more. On the other hand, if adding over 1.00%, the amount of solid solution formed at the carbides increases, the carbides become difficult to melt, and the grain size of the prior austenite of the hot stamped article can no longer be controlled to 3 μm or less, so 1.00% is made the upper limit. Preferably the content is 0.8% or less.

"B: 0.0005% to 0.010%"

B is an element contributing to improvement of strength by solution strengthening. If less than 0.0005%, the solution strengthening ability is poor, the martensite becomes softer, and it is difficult to secure a 2000 MPa or more tensile strength, so 0.0005% or more is added. Preferably the content is 0.0008% or more. On the other hand, if adding over 0.010%, the amount of solid solution formed at the carbides increases, the carbides become difficult to melt, and the average grain size of the prior austenite of the hot stamped article can no longer be controlled to 3 μm or less, so 0.010% is made the upper limit. Preferably the content is 0.007% or less.

"Nb: 0.01% to 0.15%"

Nb is an element forming a solid solution at the grain boundaries of the prior austenite and raising the strength of the grain boundaries. Further, Nb forms a solid solution at the grain boundaries to inhibit the grain boundary segregation of P, so improves the brittle strength of the grain boundaries. Furthermore, by making Nb and Mo form solid solutions in the austenite right after finish rolling and furthermore controlling the coiling conditions, it is possible to make the strength of the austenite rise. When changing phases from austenite to lower bainite or martensite or tempered martensite, a crystal orientation advantageous for easing the stress occurring due to transformation is preferentially formed. As a result, the X-ray random intensity ratio of {112}<111> of the crystal grains can be controlled. For this reason, 0.01% or more is added. Preferably the content is 0.030% or more. On the other hand, if adding over 0.15%, it easily precipitates as carbides and the amount of solid solution formed at the grain boundaries ends up decreasing, so the content is made 0.15% or less. Preferably the content is 0.12% or less.

"Mo: 0.005% to 1.00%"

Mo is an element forming a solid solution at the grain boundaries of the prior austenite and raising the strength of the grain boundaries. Further, Mo forms a solid solution at the grain boundaries to inhibit the grain boundary segregation of P, so improves the brittle strength of the grain boundaries. Furthermore, by making Nb and Mo form solid solutions in the austenite right after finish rolling and furthermore controlling the coiling conditions, it is possible to make the strength of the austenite rise. When changing phases from austenite to lower bainite or martensite or tempered martensite, a crystal orientation advantageous for easing the stress occurring due to transformation is preferentially formed. As a result, the X-ray random intensity ratio of {112}<111> of the crystal grains can be controlled. For this reason, 0.005% or more is added. Preferably the content is 0.030% or more. On the other hand, if adding over 1.00%, it easily precipitates as carbides and the amount of solid solution formed at the grain boundaries ends up decreasing, so the content is made 1.00% or less. Preferably the content is 0.80% or less.

"Ti: 0% to 0.15%"

Ti is not an essential element, but is an element contributing to improvement of strength by solution strengthening, so may be added as required. If adding Ti, to obtain the effect of addition, the content is preferably made 0.01% or more. Preferably the content is 0.02%. On the other hand, if adding over 0.15%, diameter 5 μm or more coarse carbides and nitrides are formed causing early fracture, so the content is made 0.15% or less. Preferably the content is 0.12% or less.

"Ni: 0% to 3.00%"

Ni is not an essential element, but is an element contributing to improvement of strength by solution strengthening, so may be added as required. If adding Ni, to obtain the effect of addition, the content is preferably made 0.01% or more. Preferably the content is 0.02%. On the other hand, if adding over 3.00%, the steel becomes brittle and early fracture is caused, so the content is made 3.00% or less. Preferably the content is 2.00% or less.

"P: 0.10% or Less"

P is an impurity element. It is an element which easily segregates at the grain boundaries and causes a drop in the brittle strength of the grain boundaries. If over 0.10%, the brittle strength of the grain boundaries remarkably falls and early fracture is caused, so P is made 0.10% or less. Preferably the content is 0.050% or less. The lower limit is not particularly prescribed, but if decreased to less than 0.0001%, the dephosphorization cost greatly rises and the result becomes economically disadvantageous, so in practical steel sheet, 0.0001% is the substantive lower limit.

"S: 0.10% or Less"

S is an impurity element. It is an element which forms inclusions. If over 0.10%, inclusions are formed and cause early fracture, so S is made 0.10% or less. Preferably the content is 0.0050% or less. The lower limit is not particularly prescribed, but if decreasing this to less than 0.0015%, the desulfurization cost greatly rises and the result becomes economically disadvantageous, so in practical steel sheet, 0.0015% is the substantive lower limit.

"N: 0.010% or Less"

N is an impurity element. It forms nitrides to cause early fracture, so the content is made 0.010% or less. Preferably the content is 0.0075% or less. The lower limit is not particularly prescribed, but if decreasing this to less than 0.0001%, the denitridation cost greatly rises and the result becomes economically disadvantageous, so in practical steel sheet, 0.0001% is the substantive lower limit.

The balance of the chemical composition consists of Fe and impurities. As the impurities, elements which unavoidably enter from the steel raw materials or scrap and/or in the steelmaking process and are allowed in a range not obstructing the properties of the hot stamped article of the present invention may be illustrated.

Next, the reasons for limitation of the microstructure of the steel sheet for hot stamping use of the present invention will be explained.

"90% or more of microstructure by area ratio is comprised of one or more of lower bainite, martensite, and tempered martensite"

In order for the hot stamped article to be given a 1500 MPa or more tensile strength, the microstructure has to include, by area ratio, 90% or more of martensite or tempered martensite. Preferably, the ratio is 94% or more. From the viewpoint of securing tensile strength, the microstructure may also be lower bainite. The balance is not particularly prescribed, but for example upper bainite, residual austenite, and pearlite may be mentioned.

The area ratios of the lower bainite, martensite, and tempered martensite are measured as follows:

A cross-section vertical to the sheet surface is cut from the center part of the steel sheet for hot stamping use. #600 to #1500 silicon carbide paper is used to polish the measurement surface, then particle size 1 to 6 μm diamond powder dispersed in alcohol or another diluent or pure water is used to polish the surface to a mirror finish.

This is immersed in a 1.5 to 3% nitric acid-alcohol solution for 5 to 10 seconds to bring out the high angle grain boundaries. At this time, the corrosion work is performed inside an exhaust treatment apparatus. The temperature of the work atmosphere is made ordinary temperature.

The corroded sample is washed by acetone or ethyl alcohol, then allowed to dry and used for observation under a scanning electron microscope. The scanning electron microscope used is equipped with two electron detectors. In a $9.6\times10^{-5}$ or less vacuum, a sample was irradiated with electron beams at an acceleration voltage of 10 kV and level of irradiation current of 8, and a secondary electron image in a range of the ⅛ to ⅜ position about the ¼ position of sheet thickness of the sample is captured. The capture magnification is made 10000× based on a horizontal 386 mm×vertical 290 mm screen. The number of fields captured is made 10 fields.

In the captured secondary electron image, the crystal grain boundaries and carbides are captured as bright contrast, so the positions of the crystal grain boundaries and carbides can be used to easily judge the structures. If carbides are formed inside of the crystal grains, they are tempered martensite or lower bainite. Structures in which no carbides are observed inside of the crystal grains are martensite.

On the other hand, the structures with carbides formed at the crystal grain boundaries are upper bainite or pearlite.

Regarding the residual austenite, the crystal structures are different from the above microstructure, so fields the same as the positions where the secondary electron images are captured are measured by electron backscatter diffraction method. The scanning electron microscope used is made one equipped with a camera able to be used for electron backscatter diffraction method. In a $9.6\times10^{-5}$ or less vacuum, a sample was irradiated with electron beams at an acceleration voltage of 25 kV and level of irradiation current of 16 for measurement. A face-centered cubic lattice map is prepared from the measurement data obtained.

The capture magnification is made 10000× based on a horizontal 386 mm×vertical 290 mm screen. On the photo, a 2 μm interval mesh is prepared. The microstructures positioned at the intersecting points of the mesh are selected. The value of the numbers of intersecting points of the structures divided by all of the intersecting points is made the area ratio of the microstructures. This operation is performed for 10 fields, the average value is calculated, and this is used as the area ratio of the microstructure.

"Grain boundary solid solution ratio Z defined by formula (1) of 0.4 or more"

$$Z=(\text{mass \% of one or both of Nb and Mo at grain boundaries})/(\text{mass \% of one or both of Nb and Mo at time of melting}) \quad (1)$$

The grain boundary solid solution ratio Z defined by the above formula (1) is an important structural factor in securing excellent shock absorption and is a parameter which the inventors used to evaluate the shock absorption. If Nb and/or Mo forms a solid solution at the grain boundaries, it becomes harder for P to segregate at the grain boundaries and the binding force of the grain boundaries becomes higher, so the brittle strength of the grain boundaries rises and the shock absorption ability is improved. If the grain boundary solid solution ratio Z of the hot stamped article is less than 0.4, the grain boundary strengthening effect of Nb and/or Mo is not sufficiently obtained and the required shock absorption ability cannot be obtained. If using the steel sheet for hot stamping use for hot stamping, the heat treatment causes the amounts of grain boundary solid solution of Nb and Mo to decrease, so the grain boundary solid solution ratio Z is made 0.4 or more. Preferably the ratio is 0.5 or more. The upper limit is not particularly prescribed, but theoretically 1.0 becomes the upper limit.

The grain boundary solid solution ratio Z is measured as follows:

From the center part of the steel sheet for hot stamping use, a test piece of the dimensions shown in FIG. 1 is prepared. At that time, the front and back surfaces of the test piece are mechanically ground to remove equal amounts so that the sheet thickness becomes 1.2 mm. The cut at the center part of the test piece is made by a thickness 1 mm wire cutter. The connecting part at the bottom of the cut is controlled to 100 μm to 200 μm.

Next, the test piece is immersed in a 20%-ammonium thiocyanate solution for 72 to 120 hr.

Within 0.5 hr after the end of immersion, the front and back surfaces of the test piece are galvanized.

Within 1.5 hr after plating, the sample is used for Auger electron spectroscopy. The type of the apparatus for performing the Auger electron spectroscopy is not particularly limited. The test piece is set inside the analysis apparatus and is broken from the cut part of the test piece in a $9.6\times10^{-5}$ or less vacuum to expose the prior austenite grain boundaries. The exposed prior austenite grain boundaries are irradiated with electron beams at a 1 to 30 kV acceleration voltage and the mass % (concentration) of the Nb and/or Mo at the grain boundaries is measured. The measurement is performed at the prior austenite grain boundaries at 10 or more locations. To prevent contamination of the grain boundaries, the measurements are completed within 30 minutes after the break.

The average value of the mass % (concentration) of the obtained Nb and/or Mo is calculated. The value divided by the mass % of the added Nb and/or Mo is made the grain boundary solid solution ratio Z.

"X-ray random intensity ratio of {112}<111> of crystal grains forming lower bainite or martensite or tempered martensite of 2.8 or more"

In the steel sheet for hot stamping use, if the X-ray random intensity ratio of {112}<111> of crystal grains forming lower bainite, martensite, or tempered martensite is less than 2.8, a crystal orientation with a high effect of suppression of crack progression in the hot stamped article is not formed and an excellent bending deformability can no longer be obtained. For this reason, the X-ray random intensity ratio is made 2.8 or more. The X-ray random intensity ratio is preferably 3.0 or more. The upper limit is not particularly prescribed, but in actual operation, making it 15.0 or more is difficult, so 15.0 is the substantive upper limit.

Next, the method for calculating the metal structure will be explained.

A sample is cut out from the center part of the steel sheet for hot stamping use so as to enable observation of a cross-section vertical to the surface (sheet thickness cross-section). #600 to #1500 silicon carbide paper is used to polish the measurement surface, then a solution of particle size 1 to 6 μm diamond powder dispersed in alcohol or another diluent or pure water is used to finish the sample to a mirror surface.

Next, a standard colloidal silica suspension (particle size 0.04 μm) is used for finishing polishing. The polished sample is washed by acetone or ethyl alcohol, then allowed to dry and set in a scanning electron microscope. The scanning electron microscope used is made one equipped with an EBSD detector (DVCS type detector made by TSL).

At the sheet thickness ⅜ position to ⅝ position of the sample, the range of 500 μm in the sheet thickness direction and 1000 μm in the rolling direction is measured at 0.2 μm measurement intervals by EBSD to obtain crystal orientation information. The measurement conditions are made a vacuum level of $9.6\times10^{-5}$ or less, an acceleration voltage of 15 kV, an level of irradiation current of 13, a Binning size of 8×8, and an exposure time of 62 seconds.

The measurement data is analyzed using the "OIM Analysis®" software attached to the EBSD analysis apparatus to calculate the {112}<111> X-ray random intensity ratio. Parameters loaded in the software, the "texture" function and "crystal orientation distribution" function, are used to sketch the crystal orientation distribution function in the $\varphi_2$=45° cross-section. From the sketched image, the X-ray random intensity ratio of the {112}<111> pole position is read.

"Number densities of grain size 50 nm or less cementite and epsilon carbides of total of $1\times10^{16}/m^2$ or more"

If the number densities of grain size 50 nm or less cementite and epsilon carbides are a total of $1\times10^{16}/m^2$ or more, the finely dispersed carbides become reverse transformation sites of austenite, so the prior austenite grains of the hot stamped article can be refined. If the number density is less than $1\times10^{16}/m^2$, the effect cannot be obtained, so $1\times10^{16}/m^2$ is made the lower limit. Preferably the density is $3\times10^{16}/m^2$. The upper limit is not particularly prescribed, but considering the balance of the strength demanded and suppression of early fracture, the upper limit is made $1000\times10^{16}/m^2$. Note that, if steel sheet manufactured under the manufacturing conditions prescribed in the present application, the carbides formed become mainly cementite and epsilon carbides.

Next, the method of calculation of the metal structure will be explained.

A sample is cut out from the steel sheet for hot stamping use to enable a cross-section vertical to the surface (sheet thickness cross-section) to be observed. #600 to #1500 silicon carbide paper is used to polish the measurement surface, then particle size 1 to 6 μm diamond powder dispersed in alcohol or another diluent or pure water is used to polish the surface to a mirror finish.

Next, electrolytic etching is performed by the SPEED method using the nonaqueous electrolytic solution described in "Fumio Kurosawa, Isamu Taguchi, Ryutaro Matsumoto, Journal of the Japan Institute of Metal Materials, 43, 1068 (1979)" to prepare the sample so that the fine carbides can be easily observed. This technique is one utilizing the difference in decomposition potential of carbon steel and cementite or epsilon carbides. By electrolysis at a potential where only the base iron is decomposed, it is possible to easily observe the carbides. By using a nonaqueous electrolytic solution, decomposition of the water soluble cementite or epsilon carbides is suppressed, so this is suitable for measuring the dimensions or measuring the number density of the fine carbides.

The observed surface of the sample is immersed in an acetyl acetone-based electrolytic solution and electrolyzed by a 300 mV electrolytic potential for 2 seconds. The electrolyzed sample is washed by acetone or ethyl alcohol, then allowed to dry and used for observation under a scanning electron microscope. The scanning electron microscope used is a type equipped with two electron detectors. In a $9.6\times10^{-5}$ or less vacuum, a sample is irradiated with electron beams at an acceleration voltage of 10 kV and level of irradiation current of 8. At the sheet thickness ⅜ position to ⅝ position of the sample, 10 fields of magnification 30000× are observed based on a horizontal 386 mm×vertical 290 mm image.

The number of cementite and epsilon carbides with grain sizes (lengths in long axes) of 50 nm or less contained in an observed field is measured. The value of the number of carbides contained in one field divided by the area of the observed field is calculated. A similar operation is performed for 10 fields, the average value of all fields is calculated, and this is used as the area ratio of the cementite and epsilon carbides.

Next, embodiments of the method for manufacture for obtaining the steel sheet for hot stamping use according to the present invention will be explained.

Method for Manufacturing Steel Sheet for Hot Stamping Use (1) Continuous Casting Step The molten steel having the above chemical composition is cast by the continuous casting method to obtain a steel slab. At this continuous casting step, the amount of casting of molten steel per unit time is preferably made 6 ton/min or less. If the amount of molten steel cast per unit time at the time of continuous casting (casting rate) is over 6 ton/min, microsegregation of Mn increases and the amount of nucleation of precipitates mainly comprised of Mo or Nb ends up increasing. Making the amount of casting 5 ton/min or less is further preferable. The lower limit of the amount of casting is not particularly prescribed, but from the viewpoint of the operating cost, 0.1 ton/min or more is preferable.

(2) Hot Rolling Step

The above-mentioned steel slab is hot rolled to obtain a steel sheet. At this time, the hot rolling is ended in the temperature region of the A3 transformation temperature defined by formula (2)+30° C. to the A3 transformation temperature+200° C., the final stage rolling reduction at that time is made 12% or more, the cooling is started within 1 second from the end of finish rolling, the cooling is performed through the temperature region from the temperature of the end of finish rolling to 550° C. by a 100° C./s or more cooling rate, and the steel is coiled at less than 500° C. temperature.

$$\text{A3 transformation temperature}=850+10\times(C+N)\times Mn+350\times Nb+250\times Ti+40\times B+10\times Cr+100\times Mo \quad \text{formula (2)}$$

By making the finish rolling temperature the A3 transformation temperature+30° C. or more, recrystallization of austenite is promoted. Due to this, low angle grain boundaries can be kept from forming in the crystal grains and precipitation sites for Nb and Mo can be decreased. Preferably, the temperature is the A3 transformation temperature+50° C. or more.

By making the finish rolling temperature the A3 transformation temperature+200° C. or less, excessive grain growth of the austenite is suppressed. By performing the finish rolling at the temperature region of the A3 transformation temperature+200° C. or less, the recrystallization of austenite is promoted and in addition no excessive grain growth occurs, so in the coiling step, fine carbides can be obtained. Preferably, the temperature is the A3 transformation temperature+150° C. or less.

By making the rolling reduction of the finish rolling 12% or more, recrystallization of the austenite is promoted. Due to this, formation of low angle grain boundaries in the crystal grains can be suppressed and the precipitation sites of Nb and Mo can be decreased. Preferably the content is 15% or more.

Cooling is started within 1 second from the end of the finish rolling, preferably within 0.8 second. By cooling through the temperature region from the end temperature of finish rolling down to 550° C. by a 100° C./s or more cooling rate, it is possible to decrease the dwell time in the temperature region where precipitation of Nb and Mn is promoted. As a result, it is possible to suppress precipitation of Nb and Mo in the austenite. The amounts of solid solution of Nb and Mo at the austenite grain boundaries increase.

By making the coiling temperature less than 500° C., the above effect is raised and the concentration of Mn in the carbides is suppressed to thereby cause the formation of easy to melt fine carbides and, furthermore, introduce high density dislocations into the steel. Preferably the temperature is less than 480° C. If the coiling temperature is over 500° C., the number densities of the grain size 50 nm or less cementite and epsilon carbides will not become a total of $1\times10^{16}/m^2$ or more. The lower limit is not particularly prescribed, but coiling at room temperature or less is difficult in actual operation, so room temperature is the lower limit.

Further, right after the finish rolling, Nb and Mo form solid solutions in the austenite. By transforming austenite in which Nb and Mo form solid solutions to lower bainite, martensite, or tempered martensite, a crystal orientation advantageous for easing the stress occurring due to transformation of Nb and Mo is preferentially formed, so as explained above, by starting the cooling within 1 second from the end of the finish rolling and cooling over the temperature region from the finish rolling end temperature to 550° C. by a 100° C./s or more cooling rate, it is possible to control the X-ray random intensity ratio of {112}<111> of the crystal grains.

(3) Formation of Plating Layer

The surface of the steel sheet may also be formed with a plating layer for the purpose of improving the corrosion resistance etc. The plating layer may be either of an electroplating layer and hot dip coating layer. As the electroplating layer, an electrogalvanized layer, electro Zn—Ni alloy plating layer, etc. may be illustrated. As the hot dip coating layer, a hot dip galvanized layer, hot dip galvannealed layer, hot dip aluminum plating layer, hot dip Zn—Al alloy plating layer, hot dip Zn—Al—Mg alloy plating layer, hot dip Zn—Al—Mg—Si alloy plating layer, etc. may be illustrated. The amount of the plating layer deposited is not particularly limited and may be a general amount of deposition.

(4) Other Processes

In the manufacture of the steel sheet for hot stamping use, in addition, pickling, cold rolling, temper rolling, or other known processes can be included.

Example of Process of Manufacture of Hot Stamped Article

Next, the steel sheet for hot stamping use according to the present invention will be used to explain modes of the method for manufacture for obtaining a hot stamped article. The method for obtaining the hot stamped article is not limited to the following modes.

Method of Manufacture A: Method of Obtaining Hot Stamped Article Excellent in Strength The steel sheet for hot stamping use is heated and held through the temperature region of 500° C. to the A3 point by a 100° C./s to less than 200° C./s average heating rate, then is hot stamped and shaped, then the shaped part is cooled down to room temperature. Further, to adjust the strength, part of the regions or all of the regions of the hot stamped article may be tempered at a 200° C. to 500° C. temperature.

By heating through the temperature region of 500° C. to the A3 point by a 100° C./s to less than 200° C./s average heating rate, both of the easy to melt fine carbides and high density dislocations can be used as nucleation sites of prior austenite and the average grain size of the prior austenite can be controlled to 3 μm or less. Furthermore, this contributes to suppression of precipitation of NbC and MoC during the heating and increase of the solid solution ratio of one or both of Nb and Mo at the grain boundaries of the prior austenite. Preferably, the rate is 120° C./s or more. If the average heating rate is over 200° C./s, transformation to austenite ends up being promoted while the carbides are still not completely melted and deterioration of the toughness is invited, so 200° C./s is made the upper limit. Preferably the rate is less than 180° C./s.

The holding temperature at the time of hot stamping is preferably made the A3 point+50° C. to the A3 point+150° C. Further, the cooling rate after hot stamping is preferably made 10° C./s or more.

Method of Manufacture B: Method of Obtaining Hot Stamped Article Excellent in Bending Deformation A steel sheet for hot stamping use as is, a steel sheet obtained by cold rolling the steel sheet, or a steel sheet obtained by plating that steel sheet was heated and held at the A3 point or more by an average rate of less than 100° C./s, then is hot stamped and shaped, then the shaped part is cooled down to room temperature. Further, to adjust the strength, part of the regions or all of the regions of the hot stamped article may be tempered at a 200° C. to 500° C. temperature.

The holding temperature at the time of hot stamping is preferably made the A3 point+10° C. to the A3 point+150° C. Further, the cooling rate after hot stamping is preferably made 10° C./s or more.

Examples

Next, examples of the present invention will be explained, but the conditions in the examples are just illustrations of conditions employed for confirming the workability and advantageous effects of the present invention. The present invention is not limited to the illustration of examples. The present invention can employ various conditions so long as not departing from the gist of the present invention and achieving the object of the present invention.

Molten steel of each of the chemical compositions shown in Table 1 was cast to manufacture a steel slab. This was hot rolled as shown in Table 2 to obtain a steel sheet for hot stamping use. The obtained steel sheet for hot stamping use was measured by the above-mentioned methods for the area ratios of lower bainite and martensite and tempered martensite, the grain boundary solid solution ratios of Nb and Mo, the X-ray random intensity ratio of {112}<111> of the crystal grains forming the lower bainite or martensite or tempered martensite, and the number densities of 50 nm or less cementite and epsilon carbides.

Further, the obtained steel sheet for hot stamping use was used for cold rolling and plating under the conditions shown in Table 3 to prepare a hot stamped article. The heat treatment at the time of hot stamping was changed in average heating rate in the 500° C. to A3 point temperature region.

TABLE 1

| Steel | Chemical composition/mass % | | | | | | | | | | | | | | |
|---|---|---|---|---|---|---|---|---|---|---|---|---|---|---|---|
| no. | C | Si | Mn | sol. Al | Cr | B | Nb | Mo | P | S | N | Ti | Ni | A3 (° C.) | Remarks |
| 1 | 0.28 | 0.05 | 1.1 | 0.040 | 1.00 | 0.0015 | 0.080 | 0.001 | 0.005 | 0.0020 | 0.0020 | 0.020 | | 876 | Comp. ex. |
| 2 | 0.30 | 0.24 | 1.5 | 0.040 | 0.20 | 0.0050 | 0.080 | 0.005 | 0.011 | 0.0020 | 0.0041 | 0.050 | | 877 | Comp. ex. |
| 3 | 0.17 | 0.02 | 0.6 | 0.088 | 0.05 | 0.0013 | 0.020 | 0.001 | 0.068 | 0.0220 | 0.0019 | 0.010 | | 841 | Comp. ex. |

TABLE 1-continued

| Steel | Chemical composition/mass % | | | | | | | | | | | | | | |
|---|---|---|---|---|---|---|---|---|---|---|---|---|---|---|---|
| no. | C | Si | Mn | sol. Al | Cr | B | Nb | Mo | P | S | N | Ti | Ni | A3 (° C.) | Remarks |
| 4 | 0.21 | 0.25 | 1.4 | 0.046 | 0.22 | 0.0021 | 0.015 | 0.018 | 0.015 | 0.0021 | 0.0033 | 0.025 | | 849 | Comp. ex. |
| 5 | 0.37 | 0.23 | 1.4 | 0.048 | 0.23 | 0.0018 | 0.019 | 0.017 | 0.012 | 0.0018 | 0.0034 | 0.023 | | 872 | Inv. ex. |
| 6 | 0.42 | 0.21 | 1.5 | 0.051 | 0.48 | 0.0023 | 0.084 | 0.012 | 0.012 | 0.0005 | 0.0032 | 0.029 | | 899 | Inv. ex. |
| 7 | 0.76 | 0.21 | 1.4 | 0.044 | 0.24 | 0.0021 | 0.048 | 0.011 | 0.012 | 0.0003 | 0.0036 | 0.030 | | 888 | Comp. ex. |
| 8 | 0.37 | 0.001 | 1.4 | 0.052 | 0.43 | 0.0025 | 0.088 | 0.011 | 0.015 | 0.0005 | 0.0029 | | | 871 | Comp. ex. |
| 9 | 0.36 | 0.008 | 1.4 | 0.047 | 0.44 | 0.0024 | 0.087 | 0.010 | 0.011 | 0.0004 | 0.0032 | | | 871 | Inv. ex. |
| 10 | 0.36 | 0.16 | 1.4 | 0.045 | 0.42 | 0.0024 | 0.086 | 0.011 | 0.013 | 0.0005 | 0.0032 | | | 871 | Inv. ex. |
| 11 | 0.38 | 0.22 | 1.5 | 0.046 | 0.43 | 0.0022 | 0.085 | 0.011 | 0.013 | 0.0005 | 0.0029 | | | 871 | Inv. ex. |
| 12 | 0.36 | 0.80 | 1.5 | 0.049 | 0.46 | 0.0024 | 0.086 | 0.011 | 0.014 | 0.0006 | 0.0030 | | | 871 | Comp. ex. |
| 13 | 0.38 | 0.20 | 0.3 | 0.044 | 0.50 | 0.0022 | 0.087 | 0.010 | 0.014 | 0.0006 | 0.0030 | | | 868 | Comp. ex. |
| 14 | 0.37 | 0.20 | 0.5 | 0.046 | 0.46 | 0.0022 | 0.087 | 0.013 | 0.013 | 0.0004 | 0.0032 | | | 868 | Inv. ex. |
| 15 | 0.37 | 0.18 | 1.3 | 0.050 | 0.43 | 0.0024 | 0.086 | 0.013 | 0.014 | 0.0005 | 0.0032 | | | 871 | Inv. ex. |
| 16 | 0.37 | 0.20 | 2.6 | 0.046 | 0.46 | 0.0024 | 0.086 | 0.011 | 0.011 | 0.0005 | 0.0032 | | | 876 | Inv. ex. |
| 17 | 0.36 | 0.18 | 3.6 | 0.048 | 0.42 | 0.0025 | 0.085 | 0.011 | 0.014 | 0.0004 | 0.0031 | | | 878 | Comp. ex. |
| 18 | 0.37 | 0.20 | 1.5 | 0.0001 | 0.46 | 0.0022 | 0.086 | 0.010 | 0.015 | 0.0005 | 0.0032 | | | 871 | Comp. ex. |
| 19 | 0.37 | 0.18 | 1.4 | 0.0008 | 0.45 | 0.0024 | 0.088 | 0.010 | 0.011 | 0.0005 | 0.0031 | | | 872 | Inv. ex. |
| 20 | 0.37 | 0.21 | 1.4 | 0.043 | 0.45 | 0.0023 | 0.086 | 0.013 | 0.013 | 0.0004 | 0.0032 | | | 871 | Inv. ex. |
| 21 | 0.38 | 0.18 | 1.5 | 2.8 | 0.43 | 0.0024 | 0.086 | 0.013 | 0.015 | 0.0003 | 0.0029 | | | 872 | Inv. ex. |
| 22 | 0.36 | | 1.5 | 3.7 | 0.44 | 0.0022 | 0.088 | 0.011 | 0.014 | 0.0005 | 0.0031 | | | 872 | Comp. ex. |
| 23 | 0.38 | 0.21 | 1.5 | 0.052 | 0.03 | 0.0025 | 0.084 | 0.013 | 0.014 | 0.0003 | 0.0032 | | | 867 | Comp. ex. |
| 24 | 0.38 | 0.21 | 1.4 | 0.050 | 0.08 | 0.0024 | 0.086 | 0.010 | 0.013 | 0.0003 | 0.0029 | | | 867 | Inv. ex. |
| 25 | 0.32 | 0.22 | 1.6 | 0.045 | 0.05 | 0.0005 | 0.010 | 0.002 | 0.010 | 0.0040 | 0.0040 | | | 839 | Comp. ex. |
| 26 | 0.30 | 0.15 | 1.3 | 0.028 | 0.87 | 0.0015 | 0.015 | 0.210 | 0.007 | 0.0093 | 0.0024 | 0.015 | | 873 | Comp. ex. |
| 27 | 0.36 | 0.19 | 1.5 | 0.046 | 0.41 | 0.0022 | 0.087 | 0.013 | 0.015 | 0.0006 | 0.0029 | | | 871 | Inv. ex. |
| 28 | 0.36 | 0.20 | 1.4 | 0.049 | 0.90 | 0.0024 | 0.088 | 0.013 | 0.015 | 0.0006 | 0.0029 | | | 876 | Inv. ex. |
| 29 | 0.38 | 0.20 | 1.4 | 0.051 | 1.20 | 0.0024 | 0.084 | 0.010 | 0.015 | 0.0003 | 0.0029 | | | 878 | Comp. ex. |
| 30 | 0.37 | 0.21 | 1.4 | 0.047 | 0.46 | 0.0002 | 0.087 | 0.011 | 0.013 | 0.0006 | 0.0029 | | | 871 | Comp. ex. |
| 31 | 0.36 | 0.18 | 1.4 | 0.050 | 0.44 | 0.0005 | 0.087 | 0.012 | 0.013 | 0.0006 | 0.0030 | | | 871 | Inv. ex. |
| 32 | 0.36 | 0.18 | 1.4 | 0.050 | 0.49 | 0.0024 | 0.088 | 0.010 | 0.012 | 0.0005 | 0.0029 | | | 872 | Inv. ex. |
| 33 | 0.36 | 0.19 | 1.4 | 0.048 | 0.47 | 0.0080 | 0.085 | 0.013 | 0.015 | 0.0006 | 0.0031 | | | 871 | Inv. ex. |
| 34 | 0.36 | 0.19 | 1.5 | 0.052 | 0.43 | 0.0140 | 0.086 | 0.010 | 0.014 | 0.0006 | 0.0032 | | | 871 | Comp. ex. |
| 35 | 0.38 | 0.18 | 1.5 | 0.051 | 0.49 | 0.0024 | 0.008 | 0.013 | 0.011 | 0.0005 | 0.0031 | | | 845 | Comp. ex. |
| 36 | 0.36 | 0.20 | 1.5 | 0.052 | 0.42 | 0.0023 | 0.021 | 0.010 | 0.013 | 0.0006 | 0.0031 | | | 848 | Inv. ex. |
| 37 | 0.37 | 0.19 | 1.4 | 0.045 | 0.47 | 0.0023 | 0.084 | 0.010 | 0.012 | 0.0006 | 0.0030 | | | 870 | Inv. ex. |
| 38 | 0.36 | 0.21 | 1.5 | 0.046 | 0.45 | 0.0022 | 0.14 | 0.013 | 0.014 | 0.0006 | 0.0030 | | | 890 | Inv. ex. |
| 39 | 0.36 | 0.21 | 1.4 | 0.051 | 0.44 | 0.0022 | 0.18 | 0.012 | 0.011 | 0.0006 | 0.0031 | | | 904 | Comp. ex. |
| 40 | 0.38 | 0.19 | 1.4 | 0.052 | 0.48 | 0.0025 | 0.087 | 0.002 | 0.014 | 0.0006 | 0.0029 | | | 871 | Comp. ex. |
| 41 | 0.37 | 0.20 | 1.5 | 0.044 | 0.50 | 0.0024 | 0.084 | 0.015 | 0.013 | 0.0005 | 0.0030 | | | 872 | Inv. ex. |
| 42 | 0.38 | 0.18 | 1.5 | 0.050 | 0.46 | 0.0023 | 0.087 | 0.010 | 0.012 | 0.0006 | 0.0030 | | | 872 | Inv. ex. |
| 43 | 0.38 | 0.20 | 1.5 | 0.052 | 0.47 | 0.0023 | 0.088 | 0.82 | 0.013 | 0.0006 | 0.0032 | | | 953 | Inv. ex. |
| 44 | 0.37 | 0.19 | 1.5 | 0.044 | 0.46 | 0.0022 | 0.085 | 1.24 | 0.015 | 0.0005 | 0.0031 | | | 994 | Comp. ex. |
| 45 | 0.38 | 0.20 | 1.4 | 0.047 | 0.44 | 0.0022 | 0.085 | 0.010 | 0.011 | 0.0006 | 0.0031 | | | 871 | Inv. ex. |
| 46 | 0.36 | 0.18 | 1.4 | 0.047 | 0.44 | 0.0022 | 0.084 | 0.010 | 0.130 | 0.0003 | 0.0029 | | | 870 | Comp. ex. |
| 47 | 0.38 | 0.17 | 1.4 | 0.051 | 0.49 | 0.0022 | 0.087 | 0.011 | 0.011 | 0.0003 | 0.0030 | | | 872 | Inv. ex. |
| 48 | 0.38 | 0.19 | 1.5 | 0.048 | 0.46 | 0.0024 | 0.087 | 0.011 | 0.013 | 0.12 | 0.0030 | | | 872 | Comp. ex. |
| 49 | 0.37 | 0.19 | 1.5 | 0.045 | 0.43 | 0.0024 | 0.087 | 0.013 | 0.014 | 0.0004 | 0.0030 | | | 872 | Inv. ex. |
| 50 | 0.36 | 0.20 | 1.4 | 0.049 | 0.42 | 0.0022 | 0.084 | 0.011 | 0.014 | 0.0006 | 0.025 | | | 870 | Comp. ex. |
| 51 | 0.37 | 0.19 | 1.5 | 0.045 | 0.48 | 0.0022 | 0.085 | 0.011 | 0.013 | 0.0004 | 0.0032 | 0.082 | | 892 | Inv. ex. |
| 52 | 0.36 | 0.19 | 1.5 | 0.047 | 0.49 | 0.0024 | 0.088 | 0.010 | 0.014 | 0.0006 | 0.0029 | | 0.2 | 872 | Inv. ex. |
| 4 | 0.30 | 0.24 | 1.5 | 0.040 | 0.20 | 0.0050 | 0.080 | 0.005 | 0.011 | 0.0020 | 0.0041 | 0.050 | | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | | 878 | Comp. ex. |
| 4 | 0.30 | 0.24 | 1.5 | 0.040 | 0.20 | 0.0050 | 0.080 | 0.005 | 0.011 | 0.0020 | 0.0041 | 0.050 | | 878 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |

TABLE 1-continued

| Steel | Chemical composition/mass % | | | | | | | | | | | | | | |
|---|---|---|---|---|---|---|---|---|---|---|---|---|---|---|---|
| no. | C | Si | Mn | sol. Al | Cr | B | Nb | Mo | P | S | N | Ti | Ni | A3 (° C.) | Remarks |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |

TABLE 2

| | | Manufacturing process of steel sheet for hot stamping use | | | | | | |
|---|---|---|---|---|---|---|---|---|
| Steel no. | Manufacturing no. | Amount of casting of molten steel (ton/min) | Heating temp. (° C.) | Finish rolling temp. (° C.) | Finish rolling rate (%) | Cooling start time (sec) | Cooling rate (° C./s) | Coiling start temp. (° C.) |
| 1 | 1 | 4.4 | 1242 | 910 | 15 | 0.9 | 115 | 510 |
| 2 | 2 | 7.2 | 1254 | 904 | 14 | 0.8 | 115 | 475 |
| 3 | 3 | 7.9 | 1202 | 898 | 17 | 0.8 | 198 | 625 |
| 4 | 4 | 4.3 | 1286 | 910 | 15 | 0.9 | 123 | 474 |
| 5 | 5 | 4.1 | 1276 | 908 | 17 | 0.9 | 121 | 469 |
| 6 | 6 | 4 | 1272 | 901 | 17 | 0.8 | 117 | 465 |
| 7 | 7 | 4.2 | 1278 | 910 | 17 | 0.9 | 120 | 468 |
| 8 | 8 | 4.2 | 1274 | 902 | 16 | 0.8 | 117 | 468 |
| 9 | 9 | 4.2 | 1289 | 906 | 15 | 0.9 | 123 | 472 |
| 10 | 10 | 4.4 | 1282 | 910 | 16 | 0.9 | 122 | 471 |
| 11 | 11 | 4.3 | 1286 | 899 | 14 | 0.9 | 119 | 464 |
| 12 | 12 | 4.2 | 1274 | 905 | 16 | 0.8 | 125 | 466 |
| 13 | 13 | 4.1 | 1281 | 895 | 14 | 0.9 | 119 | 462 |
| 14 | 14 | 4 | 1271 | 907 | 16 | 0.9 | 125 | 472 |
| 15 | 15 | 4.3 | 1288 | 902 | 14 | 0.9 | 115 | 473 |
| 16 | 16 | 4.3 | 1287 | 903 | 15 | 0.9 | 115 | 475 |
| 17 | 17 | 4.1 | 1278 | 897 | 16 | 0.8 | 122 | 460 |
| 18 | 18 | 4.3 | 1272 | 905 | 17 | 0.9 | 117 | 465 |
| 19 | 19 | 4.1 | 1282 | 903 | 17 | 0.7 | 117 | 474 |
| 20 | 20 | 4.2 | 1278 | 899 | 15 | 0.8 | 118 | 473 |
| 21 | 21 | 4 | 1274 | 895 | 17 | 0.7 | 124 | 475 |
| 22 | 22 | 4.3 | 1283 | 896 | 15 | 0.7 | 124 | 469 |
| 23 | 23 | 4.3 | 1281 | 910 | 14 | 0.8 | 121 | 465 |
| 24 | 24 | 4.3 | 1280 | 910 | 15 | 0.8 | 121 | 464 |
| 25 | 25 | 7.9 | 1240 | 858 | 14 | 0.9 | 121 | 453 |
| 26 | 26 | 7.9 | 1259 | 896 | 16 | 0.8 | 116 | 552 |
| 27 | 27 | 4.3 | 1283 | 907 | 17 | 0.7 | 117 | 463 |
| 28 | 28 | 4 | 1280 | 907 | 15 | 0.7 | 119 | 475 |
| 29 | 29 | 4 | 1284 | 897 | 15 | 0.7 | 119 | 467 |
| 30 | 30 | 4.3 | 1278 | 896 | 16 | 0.7 | 116 | 469 |
| 31 | 31 | 3.9 | 1275 | 896 | 14 | 0.7 | 115 | 469 |
| 32 | 32 | 3.9 | 1279 | 909 | 15 | 0.8 | 119 | 463 |
| 33 | 33 | 4 | 1277 | 905 | 15 | 0.9 | 125 | 472 |
| 34 | 34 | 4.2 | 1290 | 907 | 16 | 0.8 | 118 | 466 |
| 35 | 35 | 3.9 | 1288 | 897 | 17 | 0.9 | 125 | 471 |
| 36 | 36 | 4.4 | 1275 | 908 | 16 | 0.7 | 121 | 465 |
| 37 | 37 | 3.9 | 1273 | 910 | 17 | 0.7 | 117 | 469 |
| 38 | 38 | 4 | 1276 | 909 | 17 | 0.9 | 122 | 474 |
| 39 | 39 | 4.4 | 1272 | 949 | 15 | 0.7 | 122 | 472 |
| 40 | 40 | 4.3 | 1279 | 899 | 17 | 0.8 | 124 | 470 |
| 41 | 41 | 3.9 | 1282 | 906 | 14 | 0.7 | 121 | 466 |
| 42 | 42 | 4.1 | 1282 | 895 | 17 | 0.9 | 124 | 464 |
| 43 | 43 | 4.4 | 1286 | 965 | 15 | 0.9 | 117 | 470 |
| 44 | 44 | 3.9 | 1286 | 1005 | 14 | 0.9 | 124 | 468 |
| 45 | 45 | 4.4 | 1290 | 902 | 16 | 0.9 | 118 | 465 |
| 46 | 46 | 4.3 | 1275 | 906 | 16 | 0.8 | 119 | 468 |
| 47 | 47 | 4 | 1288 | 898 | 15 | 0.8 | 121 | 469 |
| 48 | 48 | 4.3 | 1289 | 905 | 15 | 0.9 | 121 | 471 |
| 49 | 49 | 3.9 | 1282 | 905 | 14 | 0.9 | 119 | 467 |
| 50 | 50 | 4 | 1275 | 910 | 15 | 0.7 | 121 | 468 |
| 51 | 51 | 4.3 | 1279 | 904 | 14 | 0.9 | 115 | 460 |
| 52 | 52 | 3.9 | 1274 | 898 | 15 | 0.9 | 117 | 470 |
| 4 | 53 | 5.0 | 1250 | 870 | 18 | 0.8 | 125 | 475 |
| 4 | 54 | 5.0 | 1250 | 908 | 10 | 0.8 | 125 | 475 |
| 4 | 55 | 5.0 | 1250 | 908 | 18 | 1.2 | 80 | 475 |
| 4 | 56 | 5.0 | 1250 | 908 | 18 | 0.8 | 125 | 530 |
| 4 | 57 | 5.0 | 1250 | 908 | 18 | 0.8 | 125 | 475 |
| 7 | 58 | 3 | 1277 | 903 | 15 | 0.9 | 117 | 460 |
| 7 | 59 | 5 | 1281 | 896 | 15 | 0.7 | 124 | 471 |
| 7 | 60 | 8.4 | 1288 | 910 | 16 | 0.9 | 121 | 471 |

TABLE 2-continued

| | | | | | | | | |
|---|---|---|---|---|---|---|---|---|
| 7 | 61 | 3.9 | 1277 | 855 | 14 | 0.8 | 123 | 468 |
| 7 | 62 | 4.2 | 1288 | 898 | 15 | 0.9 | 119 | 463 |
| 7 | 63 | 4 | 1272 | 905 | 16 | 0.7 | 115 | 469 |
| 7 | 64 | 4.1 | 1272 | 999 | 16 | 0.8 | 120 | 461 |
| 7 | 65 | 4.2 | 1290 | 1145 | 16 | 0.9 | 117 | 462 |
| 7 | 66 | 4.2 | 1282 | 905 | 9 | 0.7 | 123 | 463 |
| 7 | 67 | 4.2 | 1275 | 906 | 12 | 0.9 | 119 | 473 |
| 7 | 68 | 4 | 1278 | 909 | 17 | 0.7 | 120 | 473 |
| 7 | 69 | 4 | 1287 | 903 | 16 | 0.9 | 125 | 475 |
| 7 | 70 | 4.1 | 1280 | 895 | 16 | 0.8 | 122 | 465 |
| 7 | 71 | 3.9 | 1272 | 908 | 17 | 2 | 125 | 467 |
| 7 | 72 | 4 | 1283 | 896 | 14 | 0.9 | 88 | 472 |
| 7 | 73 | 4.2 | 1270 | 899 | 14 | 0.8 | 110 | 463 |
| 7 | 74 | 4.1 | 1290 | 896 | 16 | 0.9 | 119 | 471 |
| 7 | 75 | 4 | 1287 | 908 | 16 | 0.7 | 117 | 56 |
| 7 | 76 | 3.9 | 1276 | 909 | 17 | 0.9 | 117 | 467 |
| 7 | 77 | 4.2 | 1279 | 897 | 17 | 0.9 | 120 | 480 |
| 7 | 78 | 4.1 | 1271 | 898 | 15 | 0.7 | 125 | 543 |
| 7 | 79 | 4.3 | 1277 | 901 | 16 | 0.7 | 123 | 469 |
| 7 | 80 | 3.9 | 1290 | 898 | 14 | 0.7 | 119 | 464 |
| 7 | 81 | 4.1 | 1279 | 898 | 14 | 0.7 | 121 | 463 |

| | Micro structure of steel sheet for hot stamping use | | | | |
|---|---|---|---|---|---|
| Steel no. | Number density of grain size 50 nm or less cementite or epsilon carbides ($10^{16}$ $m^{-2}$) | Area ratio of lower bainite or martensite or tempered martensite (%) | Grain boundary solid solution ratio Z | X-ray random intensity ratio of {112}<111> | Remarks |
| 1 | 0.08 | 68 | 0.1 | 2.3 | Comp. ex. |
| 2 | 7.8 | 95 | 0.2 | 2.5 | Comp. ex. |
| 3 | 0.01 | 23 | 0.2 | 2.5 | Comp. ex. |
| 4 | 4.4 | 93 | 0.5 | 3.0 | Comp. ex. |
| 5 | 7 | 94 | 0.5 | 3.4 | Inv. ex. |
| 6 | 9.4 | 98 | 0.5 | 3.7 | Inv. ex. |
| 7 | 2.6 | 98 | 0.5 | 5.2 | Comp. ex. |
| 8 | 7 | 94 | 0.5 | 3.3 | Comp. ex. |
| 9 | 7.7 | 94 | 0.5 | 3.2 | Inv. ex. |
| 10 | 6.7 | 96 | 0.5 | 3.3 | Inv. ex. |
| 11 | 6.9 | 95 | 0.5 | 3.2 | Inv. ex. |
| 12 | 7.8 | 94 | 0.5 | 3.2 | Comp. ex. |
| 13 | 6.7 | 94 | 0.6 | 3.4 | Comp. ex. |
| 14 | 6.2 | 95 | 0.5 | 3.5 | Inv. ex. |
| 15 | 7.6 | 94 | 0.6 | 3.2 | Inv. ex. |
| 16 | 7.4 | 94 | 0.6 | 3.3 | Inv. ex. |
| 17 | 6.1 | 95 | 0.6 | 3.3 | Comp. ex. |
| 18 | 6.7 | 95 | 0.5 | 3.3 | Comp. ex. |
| 19 | 6.9 | 95 | 0.5 | 3.5 | Inv. ex. |
| 20 | 6.8 | 96 | 0.6 | 3.5 | Inv. ex. |
| 21 | 6.5 | 96 | 0.6 | 3.3 | Inv. ex. |
| 22 | 7.5 | 96 | 0.6 | 3.5 | Comp. ex. |
| 23 | 7.3 | 96 | 0.6 | 3.2 | Comp. ex. |
| 24 | 7.6 | 94 | 0.5 | 3.3 | Inv. ex. |
| 25 | 7.4 | 94 | 0.2 | 2.3 | Comp. ex. |
| 26 | 0.04 | 56 | 0.2 | 2.3 | Comp. ex. |
| 27 | 7.8 | 95 | 0.6 | 3.5 | Inv. ex. |
| 28 | 6.1 | 96 | 0.5 | 3.3 | Inv. ex. |
| 29 | 6.2 | 95 | 0.5 | 3.2 | Comp. ex. |
| 30 | 7.5 | 95 | 0.5 | 3.2 | Comp. ex. |
| 31 | 6.7 | 96 | 0.5 | 3.3 | Inv. ex. |
| 32 | 6.6 | 95 | 0.5 | 3.4 | Inv. ex. |
| 33 | 7 | 94 | 0.5 | 3.5 | Inv. ex. |
| 34 | 6.2 | 94 | 0.2 | 2.2 | Comp. ex. |
| 35 | 6.6 | 96 | 0.2 | 2.3 | Comp. ex. |
| 36 | 6.6 | 94 | 0.4 | 3.4 | Inv. ex. |
| 37 | 7.6 | 95 | 0.6 | 4.1 | Inv. ex. |
| 38 | 6.7 | 95 | 0.5 | 3.4 | Inv. ex. |
| 39 | 6.3 | 95 | 0.2 | 2.4 | Comp. ex. |
| 40 | 7.6 | 94 | 0.2 | 2.2 | Comp. ex. |
| 41 | 6.6 | 95 | 0.5 | 3.3 | Inv. ex. |
| 42 | 7.6 | 95 | 0.7 | 3.8 | Inv. ex. |
| 43 | 6.4 | 96 | 0.6 | 3.4 | Inv. ex. |
| 44 | 7.9 | 94 | 0.2 | 2.5 | Comp. ex. |
| 45 | 6.6 | 95 | 0.6 | 3.5 | Inv. ex. |
| 46 | 7.4 | 95 | 0.5 | 3.4 | Comp. ex. |
| 47 | 7.8 | 95 | 0.5 | 3.5 | Inv. ex. |
| 48 | 7.6 | 95 | 0.6 | 3.5 | Comp. ex. |

TABLE 2-continued

| | | | | | |
|---|---|---|---|---|---|
| 49 | 7.9 | 96 | 0.6 | 3.3 | Inv. ex. |
| 50 | 6.7 | 94 | 0.6 | 3.4 | Comp. ex. |
| 51 | 6.1 | 95 | 0.5 | 3.4 | Inv. ex. |
| 52 | 6.2 | 94 | 0.6 | 3.4 | Inv. ex. |
| 4 | 0.04 | 95 | 0.2 | 3.0 | Comp. ex. |
| 4 | 0.04 | 95 | 0.2 | 3.0 | Comp. ex. |
| 4 | 0.04 | 95 | 0.2 | 2.2 | Comp. ex. |
| 4 | 7.5 | 95 | 0.3 | 2.8 | Comp. ex. |
| 4 | 0.04 | 95 | 0.4 | 3.4 | Inv. ex. |
| 7 | 7.4 | 95 | 0.7 | 3.8 | Inv. ex. |
| 7 | 7.4 | 94 | 0.5 | 3.3 | Inv. ex. |
| 7 | 7.2 | 95 | 0.3 | 2.3 | Comp. ex. |
| 7 | 7.4 | 94 | 0.2 | 2.3 | Comp. ex. |
| 7 | 6.4 | 94 | 0.5 | 3.3 | Inv. ex. |
| 7 | 7.5 | 95 | 0.7 | 3.9 | Inv. ex. |
| 7 | 7.3 | 94 | 0.5 | 3.5 | Inv. ex. |
| 7 | 6.3 | 96 | 0.3 | 2.2 | Comp. ex. |
| 7 | 6.2 | 96 | 0.2 | 2.5 | Comp. ex. |
| 7 | 7 | 96 | 0.5 | 3.3 | Inv. ex. |
| 7 | 6.4 | 94 | 0.6 | 4.0 | Inv. ex. |
| 7 | 6.7 | 94 | 0.7 | 4.1 | Inv. ex. |
| 7 | 6.9 | 94 | 0.5 | 3.3 | Inv. ex. |
| 7 | 7.2 | 94 | 0.2 | 2.2 | Comp. ex. |
| 7 | 6.9 | 96 | 0.3 | 2.3 | Comp. ex. |
| 7 | 7.8 | 96 | 0.5 | 3.2 | Inv. ex. |
| 7 | 6.2 | 96 | 0.7 | 4.0 | Inv. ex. |
| 7 | 7.1 | 99 | 0.7 | 4.7 | Inv. ex. |
| 7 | 6.5 | 94 | 0.7 | 4.0 | Inv. ex. |
| 7 | 1.5 | 92 | 0.5 | 3.5 | Inv. ex. |
| 7 | 0.04 | 70 | 0.4 | 3.5 | Comp. ex. |
| 7 | 6.7 | 94 | 0.5 | 3.4 | Inv. ex. |
| 7 | 7.6 | 94 | 0.5 | 3.3 | Inv. ex. |
| 7 | 6.3 | 95 | 0.4 | 3.2 | Inv. ex. |

TABLE 3

| | | | | | | | | Mechanical properties | | | | |
|---|---|---|---|---|---|---|---|---|---|---|---|---|
| | | Cold rolling | | | | | | | | | | |
| | | Cold | Plating | | Hot rolling process | | | | | | | |
| Steel no. | Manufacturing no. | rolling reduction (%) | Plating | Alloying after plating | Heating rate (° C./s) | Heating temp. (° C.) | Cooling rate (° C.) | Maximum strength (MPa) | Vickers hardness (Hv) | Maximum strength/ Vickers hardness*3.3 | Maximum bending angle (°) | Remarks |
| 1 | 1 | 54 | None | None | 162 | 914 | 55 | 1922 | 809 | 0.72 | | Comp. ex. |
| 2 | 2 | 55 | None | None | 178 | 908 | 50 | 1971 | 776 | 0.77 | | Comp. ex. |
| 3 | 3 | 55 | None | None | 161 | 905 | 50 | 1160 | 533 | 0.66 | | Comp. ex. |
| 4 | 4 | 56 | None | None | 161 | 918 | 55 | 1373 | 432 | 0.96 | | Comp. ex. |
| 5 | 5 | 54 | None | None | 178 | 912 | 55 | 2052 | 637 | 0.98 | | Inv. ex. |
| 6 | 6 | 55 | None | None | 173 | 909 | 55 | 2228 | 692 | 0.98 | | Inv. ex. |
| 7 | 7 | 56 | None | None | 173 | 916 | 55 | 1518 | 641 | 0.72 | | Comp. ex. |
| 8 | 8 | 57 | None | None | 166 | 905 | 55 | 2106 | 751 | 0.85 | | Comp. ex. |
| 9 | 9 | 54 | None | None | 183 | 910 | 55 | 2127 | 661 | 0.98 | | Inv. ex. |
| 10 | 10 | 55 | None | None | 185 | 917 | 55 | 2257 | 703 | 0.97 | | Inv. ex. |
| 11 | 11 | 57 | None | None | 172 | 907 | 55 | 2015 | 630 | 0.97 | | Inv. ex. |
| 12 | 12 | 54 | None | None | 171 | 912 | 55 | 1546 | 640 | 0.73 | | Comp. ex. |
| 13 | 13 | 54 | None | None | 167 | 903 | 55 | 1522 | 480 | 0.96 | | Comp. ex. |
| 14 | 14 | 58 | None | None | 156 | 912 | 55 | 2103 | 656 | 0.97 | | Inv. ex. |
| 15 | 15 | 56 | None | None | 180 | 910 | 55 | 2226 | 692 | 0.97 | | Inv. ex. |
| 16 | 16 | 55 | None | None | 184 | 910 | 55 | 2075 | 647 | 0.97 | | Inv. ex. |
| 17 | 17 | 58 | None | None | 183 | 902 | 55 | 1780 | 642 | 0.84 | | Comp. ex. |
| 18 | 18 | 57 | None | None | 164 | 908 | 55 | 1651 | 649 | 0.77 | | Comp. ex. |
| 19 | 19 | 57 | None | None | 170 | 907 | 55 | 2123 | 656 | 0.98 | | Inv. ex. |
| 20 | 20 | 57 | None | None | 159 | 905 | 55 | 2263 | 698 | 0.98 | | Inv. ex. |
| 21 | 21 | 54 | None | None | 155 | 899 | 55 | 2032 | 628 | 0.98 | | Inv. ex. |
| 22 | 22 | 57 | None | None | 175 | 903 | 55 | 1614 | 640 | 0.76 | | Comp. ex. |
| 23 | 23 | 55 | None | None | 183 | 916 | 55 | 1546 | 480 | 0.98 | | Comp. ex. |
| 24 | 24 | 54 | None | None | 182 | 914 | 55 | 2061 | 644 | 0.97 | | Inv. ex. |
| 25 | 25 | 67 | None | None | 87 | 862 | 62 | 1665 | | | 68 | Comp. ex. |
| 26 | 26 | 54 | None | None | 20 | 898 | 49 | 1750 | | | 64 | Comp. ex. |
| 27 | 27 | 55 | None | None | 78 | 910 | 58 | 2251 | | | 68 | Inv. ex. |
| 28 | 28 | 56 | None | None | 77 | 908 | 57 | 2201 | | | 62 | Inv. ex. |
| 29 | 29 | 55 | None | None | 83 | 906 | 55 | 1787 | | | 44 | Comp. ex. |
| 30 | 30 | 57 | None | None | 42 | 901 | 61 | 1502 | | | 77 | Comp. ex. |
| 31 | 31 | 56 | None | None | 40 | 905 | 61 | 2059 | | | 69 | Inv. ex. |
| 32 | 32 | 54 | None | None | 70 | 910 | 49 | 2124 | | | 69 | Inv. ex. |

TABLE 3-continued

| Steel no. | Manufacturing no. | Cold rolling Cold rolling reduction (%) | Plating: Plating | Plating: Alloying after plating | Hot rolling process: Heating rate (° C./s) | Hot rolling process: Heating temp. (° C.) | Hot rolling process: Cooling rate (° C.) | Mechanical properties: Maximum strength (MPa) | Mechanical properties: Vickers hardness (Hv) | Mechanical properties: Maximum strength/Vickers hardness*3.3 | Mechanical properties: Maximum bending angle (°) | Remarks |
|---|---|---|---|---|---|---|---|---|---|---|---|---|
| 33 | 33 | 58 | None | None | 36 | 907 | 58 | 2006 | | | 60 | Inv. ex. |
| 34 | 34 | 58 | None | None | 52 | 909 | 53 | 1611 | | | 40 | Comp. ex. |
| 35 | 35 | 56 | None | None | 35 | 903 | 47 | 1705 | | | 40 | Comp. ex. |
| 36 | 36 | 58 | None | None | 72 | 910 | 62 | 2106 | | | 57 | Inv. ex. |
| 37 | 37 | 56 | None | None | 71 | 921 | 48 | 2302 | | | 66 | Inv. ex. |
| 38 | 38 | 58 | None | None | 79 | 914 | 59 | 2113 | | | 63 | Inv. ex. |
| 39 | 39 | 58 | None | None | 83 | 955 | 48 | 1705 | | | 36 | Comp. ex. |
| 40 | 40 | 57 | None | None | 78 | 901 | 64 | 1720 | | | 40 | Comp. ex. |
| 41 | 41 | 58 | None | None | 43 | 907 | 53 | 2001 | | | 59 | Inv. ex. |
| 42 | 42 | 58 | None | None | 64 | 901 | 61 | 2232 | | | 63 | Inv. ex. |
| 43 | 43 | 54 | None | None | 44 | 970 | 45 | 2042 | | | 61 | Inv. ex. |
| 44 | 44 | 56 | None | None | 64 | 1004 | 59 | 1686 | | | 36 | Comp. ex. |
| 45 | 45 | 54 | None | None | 47 | 913 | 55 | 2088 | | | 61 | Inv. ex. |
| 46 | 46 | 55 | None | None | 66 | 907 | 49 | 1593 | | | 41 | Comp. ex. |
| 47 | 47 | 58 | None | None | 65 | 897 | 48 | 2168 | | | 64 | Inv. ex. |
| 48 | 48 | 55 | None | None | 62 | 910 | 55 | 1572 | | | 44 | Comp. ex. |
| 49 | 49 | 55 | None | None | 51 | 915 | 56 | 2210 | | | 64 | Inv. ex. |
| 50 | 50 | 55 | None | None | 41 | 911 | 62 | 1639 | | | 43 | Comp. ex. |
| 51 | 51 | 57 | None | None | 69 | 912 | 61 | 2352 | | | 63 | Inv. ex. |
| 52 | 52 | 57 | None | None | 37 | 902 | 64 | 2140 | | | 61 | Inv. ex. |
| 4 | 53 | 58 | None | None | 165 | 900 | 60 | 1955 | 780 | 0.76 | | Comp. ex. |
| 4 | 54 | 58 | None | None | 165 | 900 | 60 | 1945 | 760 | 0.78 | | Comp. ex. |
| 4 | 55 | 58 | None | None | 165 | 900 | 60 | 1952 | 765 | 0.77 | | Comp. ex. |
| 4 | 56 | 58 | None | None | 165 | 900 | 60 | 1945 | 760 | 0.78 | | Comp. ex. |
| 4 | 57 | 58 | None | None | 165 | 900 | 60 | 2050 | 700 | 0.89 | | Inv. ex. |
| 7 | 58 | 55 | None | None | 165 | 906 | 55 | 2178 | 674 | 0.98 | | Inv. ex. |
| 7 | 59 | 54 | None | None | 170 | 903 | 55 | 2369 | 740 | 0.97 | | Inv. ex. |
| 7 | 60 | 56 | None | None | 174 | 913 | 55 | 1598 | 641 | 0.76 | | Comp. ex. |
| 7 | 61 | 57 | None | None | 185 | 887 | 55 | 1521 | 646 | 0.71 | | Comp. ex. |
| 7 | 62 | 55 | None | None | 156 | 906 | 55 | 2089 | 647 | 0.98 | | Inv. ex. |
| 7 | 63 | 57 | None | None | 178 | 913 | 55 | 2192 | 682 | 0.97 | | Inv. ex. |
| 7 | 64 | 57 | None | None | 156 | 1002 | 55 | 2039 | 635 | 0.97 | | Inv. ex. |
| 7 | 65 | 58 | None | None | 179 | 1153 | 55 | 1793 | 647 | 0.84 | | Comp. ex. |
| 7 | 66 | 56 | None | None | 175 | 913 | 55 | 1763 | 640 | 0.83 | | Comp. ex. |
| 7 | 67 | 57 | None | None | 163 | 913 | 55 | 2149 | 666 | 0.98 | | Inv. ex. |
| 7 | 68 | 54 | None | None | 157 | 915 | 55 | 2214 | 691 | 0.97 | | Inv. ex. |
| 7 | 69 | 55 | None | None | 174 | 910 | 55 | 2154 | 675 | 0.97 | | Inv. ex. |
| 7 | 70 | 54 | None | None | 82 | 897 | 53 | 2197 | | | 63 | Inv. ex. |
| 7 | 71 | 57 | None | None | 75 | 914 | 62 | 1602 | | | 39 | Comp. ex. |
| 7 | 72 | 57 | None | None | 49 | 901 | 49 | 1633 | | | 38 | Comp. ex. |
| 7 | 73 | 55 | None | None | 74 | 907 | 60 | 2143 | | | 60 | Inv. ex. |
| 7 | 74 | 57 | None | None | 83 | 898 | 63 | 2217 | | | 68 | Inv. ex. |
| 7 | 75 | 56 | None | None | 65 | 907 | 57 | 2259 | | | 77 | Inv. ex. |
| 7 | 76 | 58 | None | None | 56 | 911 | 47 | 2085 | | | 66 | Inv. ex. |
| 7 | 77 | 54 | None | None | 38 | 898 | 59 | 2034 | | | 59 | Inv. ex. |
| 7 | 78 | 56 | None | None | 77 | 909 | 59 | 1587 | | | 36 | Comp. ex. |
| 7 | 79 | 0 | None | None | 71 | 905 | 51 | 2252 | | | 68 | Inv. ex. |
| 7 | 80 | 57 | Yes | None | 55 | 907 | 58 | 2004 | | | 61 | Inv. ex. |
| 7 | 81 | 54 | Yes | Yes | 46 | 903 | 54 | 2165 | | | 58 | Inv. ex. |

Samples obtained by preparation of hot stamped articles by an average heating rate in the 500° C. to A3 point temperature region of 100° C./s or more were measured for tensile strength and further evaluated for shock absorption ability.

Samples obtained by preparation of hot stamped articles by an average heating rate in the 500° C. to A3 point temperature region of less than 100° C./s were measured for tensile strength and further evaluated for bending deformability.

Further, the shock absorption ability was evaluated by the presence of any early fracture. A material not fracturing early under the following evaluation criteria was deemed as passing. An excellent shock absorption ability means a large amount of energy absorption at the time of collision. That is, the integrated value of the stress-strain curve was large. This can be evaluated by the absence of early fracture (fracture after reaching maximum stress).

If the value of the maximum strength obtained in the tensile test divided by 3.3 times of the Vickers hardness of the material was 0.85 or more and it was judged that early fracture was suppressed. The Vickers hardness of the material was measured by the following method.

A cross-section vertical to the sheet surface is cut from the hot stamped article. #600 to #1500 silicon carbide paper was used to polish the measurement surface, then particle size 1 to 6 μm diamond powder dispersed in alcohol or another diluent or pure water was used to polish the surface to a mirror finish. A Vickers hardness tester was used to measure 10 points at the sheet thickness ¼ position by a load of 1 kgf and measurement intervals of intervals of 3 times or more of the indentation marks. The average value was made the hardness of the steel sheet.

The bending deformability was evaluated based on the VDA standard (VDA238-100) prescribed by the German Association of the Automotive Industry. In the present invention, the displacement at the time of maximum load obtained in a bending test was converted to angle in the VDA standard, the maximum bending angle was found, and a material with a maximum bending angle of 50° or more was deemed as passing.

Test piece dimensions: 60 mm (rolling direction)×30 mm (direction vertical to rolling), sheet thickness 1.0 mm Bending ridgeline: direction perpendicular to rolling Test method: roll support, punch pressing Roll diameter: φ30 mm Punch shape: tip R=0.4 mm Distance between rolls: 2.0×1.0 (mm)+0.5 mm Pressing rate: 20 mm/min Tester: SHIMAZU AUTOGRAPH 20 kN The steel sheet for hot stamping use of the present invention could be confirmed to have a tensile strength of 2000 MPa or more and an excellent bending deformability. On the other hand, in examples where the chemical compositions and methods of manufacture were not suitable, the targeted properties could not be obtained.

The invention claimed is:

1. A steel sheet for hot stamping use, a chemical composition of the steel sheet comprising, by mass %, C: 0.35% to 0.75%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0 to 3.00%, P: 0.10% or less, S: 0.10% or less, N: 0.010% or less, and a balance of Fe and unavoidable impurities, a microstructure of the steel sheet comprising at least one of lower bainite, martensite, and tempered martensite in an area ratio of 90% or more, a grain boundary solid solution ratio Z defined by Z=(mass % of one or both of Nb and Mo at grain boundaries)/(mass % of one or both of Nb and Mo) being 0.4 or more, an X-ray random intensity ratio of {112}<111> of the crystal grains forming the above lower bainite, martensite, or tempered martensite being 2.8 or more, number densities of total of grain size 50 nm or less cementite and epsilon carbides being $1\times10^{16}/m^2$ or more.

2. The steel sheet for hot stamping use according to claim 1, wherein the steel sheet comprises a plating layer.

* * * * *